US009105961B2

(12) United States Patent
Feller et al.

(10) Patent No.: US 9,105,961 B2
(45) Date of Patent: Aug. 11, 2015

(54) LOW PROFILE, WIDEBAND GNSS DUAL FREQUENCY ANTENNA STRUCTURE

(71) Applicant: Hemisphere GNSS Inc., Scottsdale, AZ (US)

(72) Inventors: Walter J. Feller, Airdrie (CA); Xiaoping Wen, Calgary (CA)

(73) Assignee: HEMISPHERE GNSS INC., Scottsdale, AZ (US)

( * ) Notice: Subject to any disclaimer, the term of this patent is extended or adjusted under 35 U.S.C. 154(b) by 3 days.

(21) Appl. No.: 14/214,001

(22) Filed: Mar. 14, 2014

(65) Prior Publication Data

US 2014/0266918 A1 Sep. 18, 2014

Related U.S. Application Data

(60) Provisional application No. 61/781,457, filed on Mar. 14, 2013.

(51) Int. Cl.
*H01Q 9/04* (2006.01)

(52) U.S. Cl.
CPC ..... *H01Q 9/0414* (2013.01); *H01Q 9/0435* (2013.01)

(58) Field of Classification Search
CPC ..... H01Q 9/0414; H01Q 9/0435
See application file for complete search history.

(56) References Cited

U.S. PATENT DOCUMENTS

| | | | | |
|---|---|---|---|---|
| 5,003,318 | A * | 3/1991 | Berneking et al. | 343/700 MS |
| 6,505,117 | B1 | 1/2003 | Ratert et al. | |
| 6,516,271 | B2 | 2/2003 | Upadhyaya et al. | |
| 6,539,303 | B2 | 3/2003 | McClure et al. | |
| 6,995,709 | B2 * | 2/2006 | Spittler | 343/700 MS |
| 7,268,727 | B2 | 9/2007 | Montgomery et al. | |
| 7,292,186 | B2 | 11/2007 | Miller et al. | |
| 7,315,278 | B1 | 1/2008 | Bauregger et al. | |
| 7,429,952 | B2 * | 9/2008 | Sun | 343/700 MS |
| 8,102,325 | B2 | 1/2012 | Feller et al. | |
| 8,184,050 | B2 | 5/2012 | Le Sage et al. | |
| 8,190,337 | B2 | 5/2012 | McClure et al. | |
| 2008/0180336 | A1 * | 7/2008 | Bauregger | 343/753 |
| 2009/0273522 | A1 * | 11/2009 | Tatarnikov et al. | 343/700 MS |
| 2011/0025574 | A1 * | 2/2011 | Tiezzi et al. | 343/700 MS |
| 2012/0050104 | A1 | 3/2012 | Jakab et al. | |
| 2012/0326932 | A1 | 12/2012 | Hsu et al. | |
| 2013/0106640 | A1 | 5/2013 | Wang et al. | |
| 2013/0162477 | A1 | 6/2013 | Waters et al. | |

(Continued)

OTHER PUBLICATIONS

"International Preliminary Report on Patentability and Written Opinion", PCT/US2009/063594, May 10, 2011.

(Continued)

*Primary Examiner* — Michael C Wimer
*Assistant Examiner* — Michael Bouizza
(74) *Attorney, Agent, or Firm* — Schmeiser, Olsen & Watts LLP; Lowell W. Gresham; Sean K. Enos

(57) ABSTRACT

GNSS signals are centered around two bands, L1 and L2, and antennas must cover both these bands for good RTK performance. GPS is at a lower frequency in both bands than the Russian GLONASS system. What is described herein is a method of constructing a low profile dual frequency wideband antenna with excellent polarization and signal reception for both GPS and GLONASS. This technique minimizes the impact of tolerances of the dielectrics, thicknesses and tuning by optimal construction.

6 Claims, 4 Drawing Sheets

(56) References Cited

U.S. PATENT DOCUMENTS

| | | | |
|---|---|---|---|
| 2013/0194133 | A1 | 8/2013 | Desclos et al. |
| 2013/0207838 | A1 | 8/2013 | Kobayashi |
| 2013/0222202 | A1 | 8/2013 | Lam |
| 2013/0241768 | A1 | 9/2013 | Petersen |
| 2013/0335264 | A1 | 12/2013 | Revol et al. |
| 2014/0043204 | A1 | 2/2014 | Basnayake et al. |
| 2014/0077865 | A1 | 3/2014 | Ashjaee et al. |
| 2014/0139376 | A1 | 5/2014 | Liu et al. |

OTHER PUBLICATIONS

"International Search Report and Written Opinion", PCT/US2009/063594, Jan. 11, 2010.

* cited by examiner

LOW PROFILE, WIDEBAND GNSS DUAL FREQUENCY ANTENNA STRUCTURE

CROSS-REFERENCE TO RELATED APPLICATION

This application claims priority in U.S. Provisional Patent Application No. 61/781,457, filed Mar. 14, 2013, which is incorporated herein by reference. U.S. Pat. No. 8,102,325 is also incorporated herein by reference.

BACKGROUND OF THE INVENTION

I. Field of the Invention

The present invention relates generally to antennas, and in particular to a low profile, wideband, GNSS dual frequency antenna structure.

II. Description of the Related Art

Various antenna designs and configurations have been produced for transmitting and receiving electromagnetic (wireless) signals. Antenna design criteria include the signal characteristics and the applications of the associated equipment, i.e. transmitters and receivers. For example, stationary, fixed applications involve different antenna design configurations than mobile equipment.

Global navigation satellite systems (GNSSs) have progressed within the last few decades to their present state-of-the-art, which accommodates a wide range of positioning, navigating and informational functions and activities. GNSS applications are found in many industries and fields of activity. For example, navigational and guidance applications involve portable GNSS receivers ranging from relatively simple, consumer-oriented, handheld units to highly sophisticated airborne and marine vessel equipment.

Vehicle-mounted antennas are designed to accommodate vehicle motion, which can include movement in six degrees of freedom, i.e. pitch, roll and yaw corresponding to vehicle rotation about X, Y and Z axes in positive and negative directions respectively. Moreover, variable and dynamic vehicle attitudes and orientations necessitate antenna gain patterns which provide GNSS ranging signal strengths throughout three-dimensional ranges of motion corresponding to the vehicles' operating environments. For example, aircraft in banking maneuvers often require below-horizon signal reception. Ships and other large marine vessels, on the other hand, tend to operate relatively level and therefore normally do not require below-horizon signal acquisition. Terrestrial vehicles have varying optimum antenna gain patterns dependent upon their operating conditions. Agricultural vehicles and equipment, for example, often require signal reception in various attitudes in order to accommodate operations over uneven terrain. Modern precision agricultural GNSS guidance equipment, e.g., sub-centimeter accuracy, requires highly efficient antennas which are adaptable to a variety of conditions.

Another antenna/receiver design consideration in the GNSS field relates to multipath interference, which is caused by reflected signals that arrive at the antenna out of phase with the direct signal. Multipath interference is most pronounced at low elevation angles, e.g., from about 10° to 20° above the horizon. They are typically reflected from the ground and ground-based objects. Antennas with strong gain patterns at or near the horizon are particularly susceptible to multipath signals, which can significantly interfere with receiver performance based on direct line-of-sight (LOS) reception of satellite ranging signals and differential correction signals (e.g., DGPS). Therefore, important GNSS antenna design objectives include achieving the optimum gain pattern, balancing rejecting multipath signals and receiving desired ranging signals from sources, e.g., satellites and pseudolites, at or near the horizon.

The present invention addresses these objectives by providing GNSS antennas with selectable gain patterns. For example, a wide beamwidth with tracking capability below the horizon is possible with a taller central support mounting a radiating element arm assembly of a crossed-dipole antenna. A wide beamwidth is preferred for vehicles which have significant pitch and roll, such as aircraft and small watercraft. By reducing the height of the central support structure a much steeper roll off at the horizon is generated with attenuated back lobes, which is preferred for maximal multipath rejection in high accuracy applications. Such alternative configurations can be accommodated by changing the height of the support element, which is preferably designed and built for assembly in multiple-height configurations depending upon the particular intended antenna applications.

Another beamwidth-performance variable relates to the deflection or "droop" of the crossed-dipole radiating element arms, which can range from nearly horizontal to a "full droop" position attached at their ends to a ground plane. Wider beam widths are achieved by increasing the downward deflection whereas multipath rejection is enhanced by decreasing droop. Preferably a selectable gain antenna accommodates such alternative configurations without significantly varying the input impedance whereby common matching and phasing networks can be used for all applications.

A typical approach to construct a dual frequency low profile antenna is to use stacked patches constructed of ceramic material with a dielectric constant of approximately 10. This approach typically results in a compact antenna, but due to the relatively high dielectric constant the bandwidth is quite narrow, which compromises reception performance for both Global Positioning System (GPS), GLONASS (Russian navigation satellite system) and other global navigation satellite systems (GNSSs), unless the ceramic is very thick. This increases the cost and creates issues with coupling between both patches, making it difficult to get the right gain pattern and polarization. A further issue is the use of a single feed point on both patches to minimize the impact of the feed for the top element passing through the second element. This relies on a dual resonance patch and the phase difference of this dual resonance to be exactly 90 degrees at the center frequency. This further limits the bandwidth where the antenna operates with the correct polarization.

Heretofore there has not been available an antenna with the advantages and features of the present invention.

SUMMARY OF THE INVENTION

In the practice of an aspect of the present invention, a low-profile, wideband GNSS dual frequency antenna structure is provided. A construction method minimizes the impact of tolerances of the dielectrics, thicknesses and tuning by optimal construction.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

Figure 1:
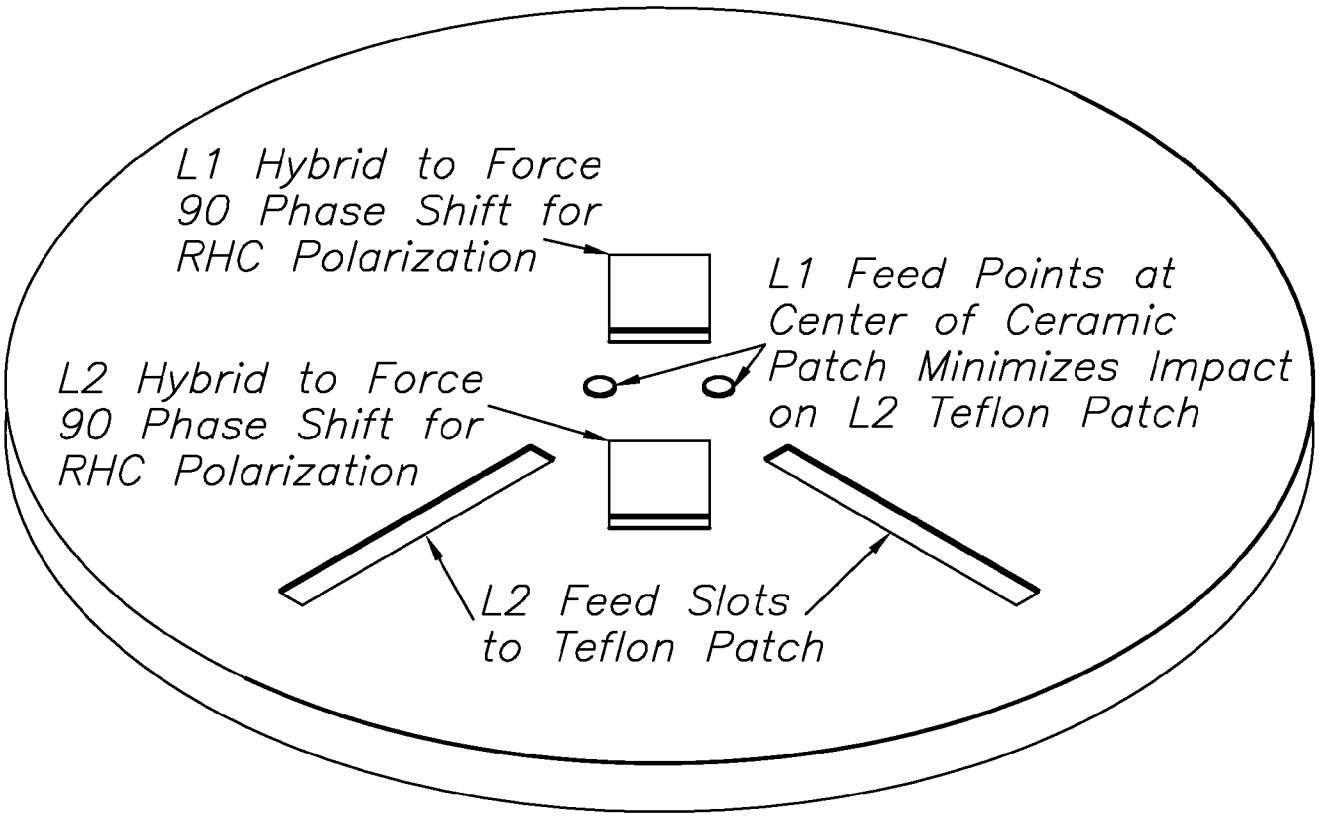
FIG. 1 is an upper, perspective view of a dual frequency, low-profile antenna embodying an aspect of the present invention.
Figure 2:
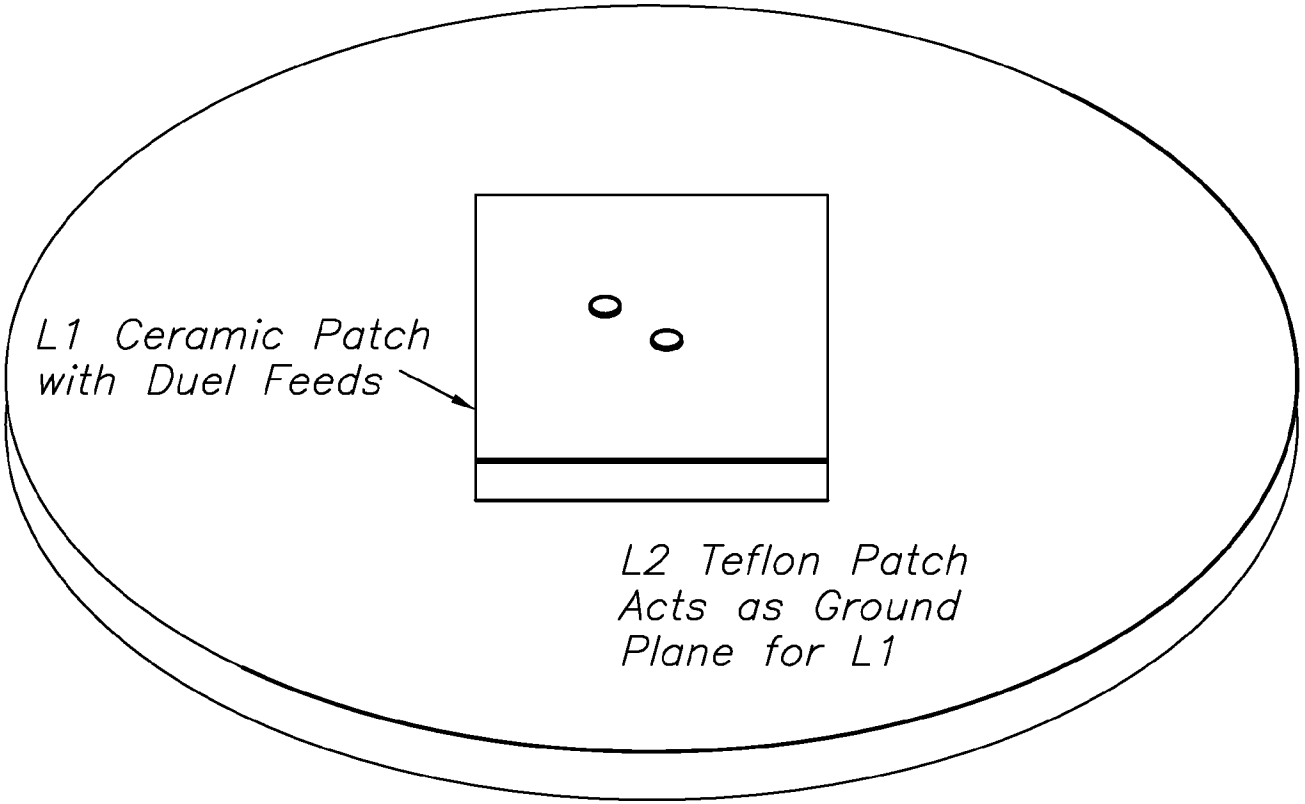
FIG. 2 shows the antenna with a L1 ceramic patch with dual feeds method on a L2 Teflon patch acting as a ground plane for L1.
Figure 3:
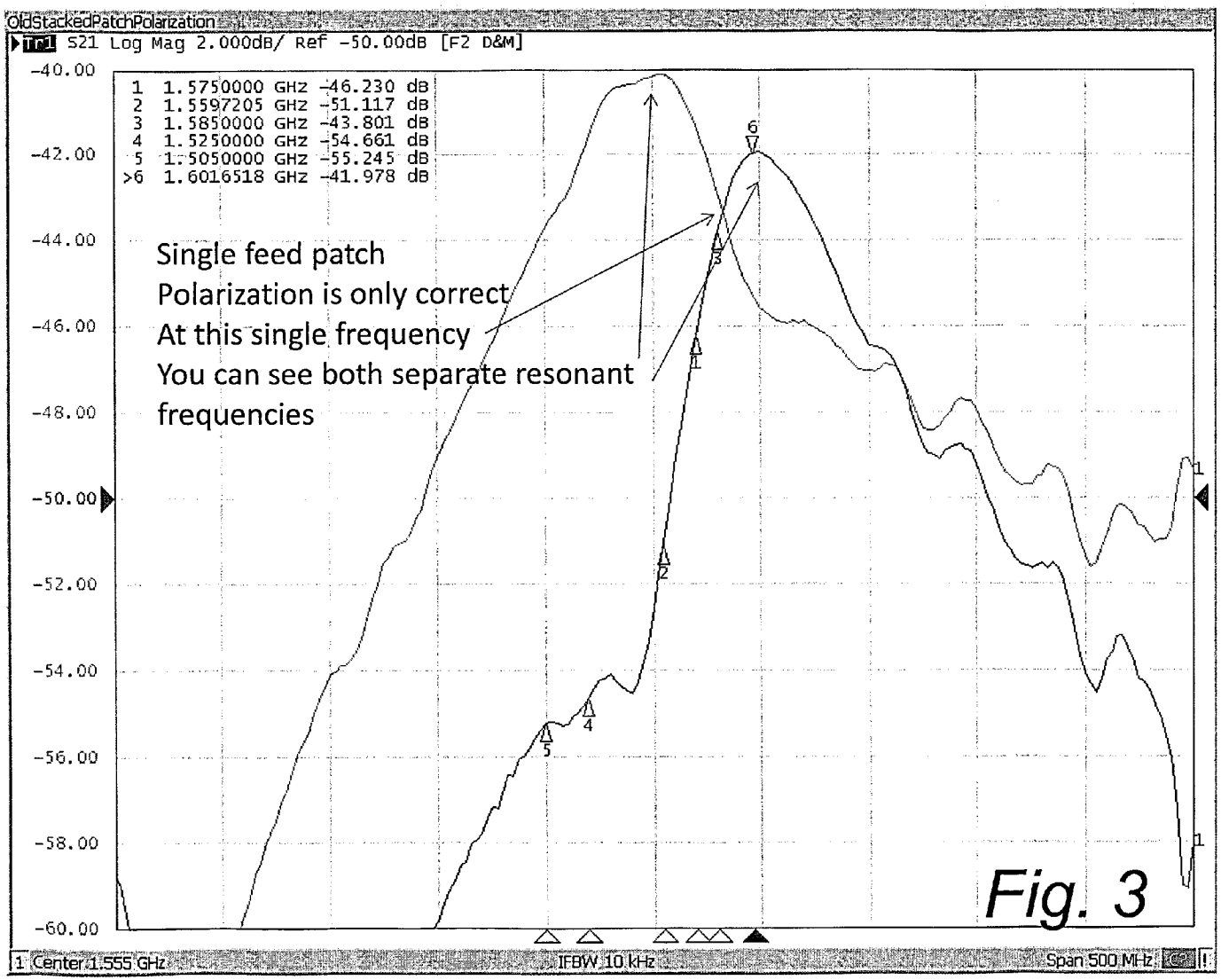
FIG. 3 is a graph showing the performance of a single feed patch embodiment.
Figure 4:
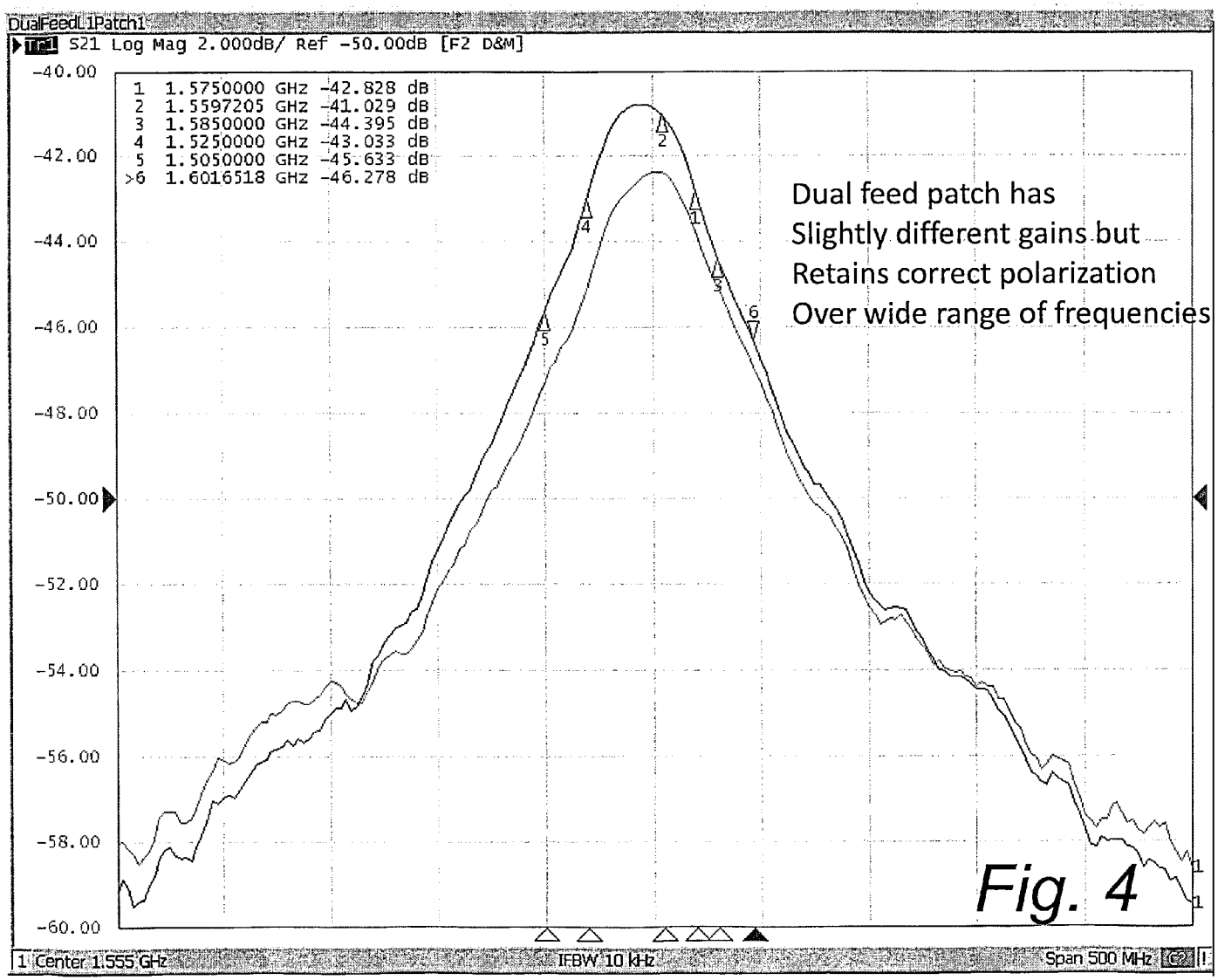
FIG. 4 is a graph showing the performance of a dual feed patch embodiment.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, up, down, front, back, right and left refer to the invention as oriented in the view being referred to. The words "inwardly" and "outwardly" refer to directions toward and away from, respectively, the geometric center of the embodiment being described and designated parts thereof. Said terminology will include the words specifically mentioned, derivatives thereof and words of similar meaning Global navigation satellite systems (GNSS) are broadly defined to include GPS (U.S.), Galileo (proposed), GLONASS (Russia), Beidou (Compass) (China), IRNSS (India, proposed), QZSS (Japan, proposed) and other current and future positioning technology using signals from satellites, with or without augmentation from terrestrial sources. Yaw, pitch and roll refer to moving component rotation about the Z, X and Y axes respectively. Said terminology will include the words specifically mentioned, derivatives thereof and words of similar meaning.

II. Preferred Embodiments

The antenna herein is constructed using a lower dielectric constant (around 3) for the low frequency patch which resides under the higher frequency patch. With a lower dielectric constant the element has to be larger (wavelength is proportional to 1/(sqrt (dielectric constant)) and a patch antenna is typically ½ wavelength) and, as it is the lower frequency, the element has to be larger so it can act as a suitable ground plane for the higher frequency element on top. The higher frequency element is constructed with a higher dielectric constant (around 10) so it is much smaller and will also have less impact on the resonance of the lower structure for the lower frequency.

A further improvement to existing elements is the use of dual feed points which are located at 90 degrees rotation from each other. This permits a forcing of the phase of the two resonances of the patch using a hybrid splitter to be exactly 90 degrees. By doing this rather than relying on a single feed point and relying on separate resonances to create the phase shift the polarization is retained over a much wider bandwidth.

Another critical benefit of the high dielectric constant patch is the two feed points are very close to the center. This is important as they must pass through the lower patch and if they are not close to the center they will change the lower patch. This is because the center of a ½ wavelength patch is a high current, low Voltage location (low impedance) so an apparent short will not affect it as much. This makes designing the lower resonant patch much simpler and less tolerance dependent.

The invention is equally implementable using four feeds (quad feed configuration) as an alternative embodiment to the dual feed configuration. A quad feed forces the phase rotation to maintain Right-Hand Circular Polarization (RHCP) even more, but adds complexity to the feed network to create the 0°, 90°, 180° and 270° phases.

It is to be understood that the invention can be embodied in various forms, and is not to be limited to the examples discussed above. The range of components and configurations which can be utilized in the practice of the present invention is virtually unlimited.

Having thus described the invention, what is claimed as new and desired to be secured by Letters Patent is:

1. A dual frequency global navigation satellite system (GNSS) antenna, which includes:

a low-frequency patch having a first dielectric element with a first dielectric constant;

a high-frequency patch positioned over the low-frequency patch and having a second dielectric element with a second dielectric constant;

said second dielectric constant being higher than said first dielectric constant;

a first 90° hybrid splitter configured for forcing an approximately 90° phase shift for right-hand circular (RHC) polarization of a low-frequency band;

a second 90° hybrid splitter configured for forcing an approximately 90° phase shift for RHC polarization of a high-frequency band;

dual feed points in said high-frequency patch located at approximately 90° rotation from each other and configured for forcing a phase shift of the low-frequency band; and dual feed slots in said low-frequency patch located at approximately 90° rotation from each other and configured for forcing a phase shift of the high-frequency band.

2. The antenna according to claim 1, which includes:

said low-frequency patch providing a ground plane for said high-frequency patch.

3. The antenna according to claim 1, which includes:

said low-frequency patch comprising polytetrafluoroethylene (PTFE) material.

4. The antenna according to claim 1, which includes:

said high-frequency patch comprising a ceramic patch with dual feeds.

5. The antenna according to claim 2, which includes:

said low-frequency and said high-frequency patches maintaining correct polarization over a wide range of frequencies.

6. A dual frequency GNSS antenna, which includes:

a low-frequency patch having a first dielectric element with a first dielectric constant;

a high-frequency patch positioned over the low-frequency patch and having a second dielectric element with a second dielectric constant;

said second dielectric constant being higher than said first dielectric constant;

a first 90° hybrid splitter configured for forcing an approximately 90° phase shift for right-hand circular (RHC) polarization of a low-frequency band;

a second 90° hybrid splitter configured for forcing an approximately 90° phase shift for RHC polarization of a high-frequency band;

dual feed points in said high-frequency patch located at approximately 90° rotation from each other and configured for forcing a phase shift of the low-frequency band;

dual feed slots in said low-frequency patch located at approximately 90° rotation from each other and configured for forcing a phase shift of the high-frequency band;

said low-frequency patch providing a ground plane for said high-frequency patch;

said low-frequency patch comprising polytetrafluoroethylene (PTFE) material;

said high-frequency patch comprising a ceramic patch with said dual feeds; and said low-frequency and said high-frequency patches being configured for maintaining correct polarization over a wide range of frequencies.

* * * * *